United States Patent [19]

Beretta

[11] 4,306,487

[45] Dec. 22, 1981

[54] SAFETY DEVICE FOR A PISTOL

[75] Inventor: Pier C. Beretta, Gardone V. T., Italy

[73] Assignee: Fabbrica d'Armi Pietro Beretta S.p.A., Gardone V. T., Italy

[21] Appl. No.: 12,308

[22] Filed: Feb. 15, 1979

[30] Foreign Application Priority Data

Feb. 24, 1978 [IT] Italy ..... 5132 A/78

[51] Int. Cl.[3] ..... F41C 17/04

[52] U.S. Cl. ..... 89/148; 42/70 F

[58] Field of Search ..... 42/70 F; 89/148

[56] References Cited

U.S. PATENT DOCUMENTS 1,712,411 5/1929 Walther ..... 89/148

3,633,303 1/1972 Volkmar et al. ..... 42/70 F

FOREIGN PATENT DOCUMENTS 2108010 8/1972 Fed. Rep. of Germany ..... 42/70 F

*Primary Examiner*—Stephen C. Bentley

[57] ABSTRACT

In a pistol of the type having a firing pin formed of two linearly consecutive elements, that are either aligned or non-aligned with each other, a sear for engaging the hammer and an arming trigger bar for arming the trigger there is provided a safety device comprising a safety shaft transversely mounted in the breech block and carrying the rearward portion of the two-part firing pin. The safety shaft is angularly displaceable about its own axis, so as to activate and deactivate the firing pin. Further, the device has an intermediate rocker lever that engages a first cam surface of the safety shaft so as to arrest the sear in an inactive position when the firing pin is deactivated. This intermediate rocker lever is pivoted on the crown of the weapon so as to be positioned between the safety shaft and the sear. There is also provided a spring-loaded piston guided within the breech block and engaged by a second cam surface of the safety shaft, so as to act upon the trigger bar and to disengage the trigger bar from the sear when the firing pin is deactivated.

4 Claims, 5 Drawing Figures

SAFETY DEVICE FOR A PISTOL

BACKGROUND OF THE INVENTION

1. Field of the Invention

The present invention relates, in general, to safety devices for pistols that include provisions for the automatic disengagement of the hammer and, more particularly, to a safety means for automatic pistols of the type having a so-called interrupted firing pin which is formed of two portions linearly positioned, of which one can be non-aligned with respect to the other, when the weapon is in safety position.

DESCRIPTION OF THE PRIOR ART

Already known are safety means for automatic pistols, which provide for the displacement of the firing pin or of a part of the firing pin, so that the pin is no longer subjected to the action of the hammer and the firing of the shell in the barrel is prevented.

The object of the present invention is that of providing a safety means which, besides acting on the firing pin in the sense of neutralizing its action, determines also the automatic disengagement of the hammer immediately after the neutralization of the firing pin. This double action is intended to prevent the accidental firing of the shells due to the uncontrolled or accidental disengagement of the hammer, when the safety is removed and the weapon is reactivated.

Another object of the invention is to provide a safety means of the type mentioned above, which also acts on the trip rod connected to the trigger, so that the trip rod is detached from the sear of the hammer and, thus, one is unable to prevent forcing the triping mechanism when the weapon is in the safety position.

SUMMARY OF THE INVENTION

Briefly stated, the present invention relates to a device for a pistol of the type having a firing pin formed of two linearly consecutive elements which are aligned with each other, of which the rear one can be made non-aligned with respect to the front one. The type of pistol to which the present invention is directed further includes a sear for engaging the hammer and an arming trigger bar for arming the trigger and associated with the sear. A safety device in accordance with the present invention comprises a safety shaft transversely mounted in the breech block and carrying the rear element of the firing pin. The safety shaft is displaceable and may be angularly displaced about its own axis, so as to activate and deactivate the firing pin. Further, the device comprising the present invention has an intermediate rocker lever engaged by a first cam surface of the safety shaft and associated with the sear, so as to arrest the sear in an inactive position when the firing pin is deactivated. This intermediate rocker lever is pivoted on the crown of the weapon so as to be positioned between the safety shaft and the sear. To complete the device of this invention, there is a spring-loaded piston guided within the breech block and engaged by a second cam surface of the safety shaft, so as to act upon the trigger bar and to disengage the pull-rod from the sear when the firing pin is deactivated.

BRIEF DESCRIPTION OF THE DRAWING

These and other objects of the invention will become apparent from the following detailed description thereof and from the accompanying drawings, which are an illustrative representation of an automatic pistol, and in which.

DESCRIPTION OF THE PREFERRED EMBODIMENT

Figure 3:
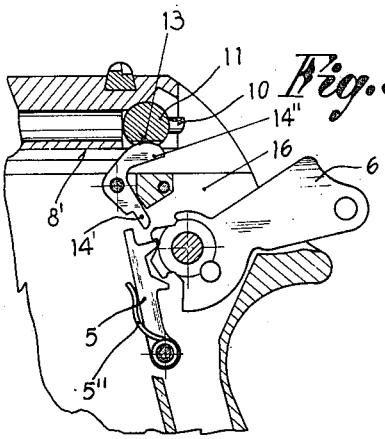
FIGS. 3 and 4 are fragmentary partial sectional elevational views taken in the plane of the intermediate lever with the safety shaft in inactive and active positions, respectively.

Referring to the drawings, trigger 1 of the pistol is attached to a trigger bar 3 proximate one extremity thereof. The opposed extremity of the trigger bar 3 has a projection 4 facing toward and associated with projection 5' of a sear 5 which serves to engage and disengage a hammer 6 of the weapon. The trigger bar 3 engages a spring 7 which keeps the trigger bar 3 normally displaced upwardly, so that the projection 4 coincides with nose 5' of the sear 5. In turn, sear 5 is urged by a spring 5'' which keeps the trigger bar 3 displaced toward hammer 6 as shown in FIG. 3. The hammer 6 acts upon a firing pin that is mounted on and guided in a breech block 8 of the pistol. The firing pin is comprised of a front, spring-loaded, rod-like element 9 and a rear, rod-like element 10, positionable in alignment and in non-alignment with the front rod-like element 9 so as to activate and deactivate the firing pin, respectively.

In greater detail, the rear, rod-like element 10 of the firing pin is seated in a diametrical opening provided in a safety shaft 11, which is mounted transversely in the breech block 8 and which is displaceable and positionable angularly about its own axis, so as to position the rear, rod-like element 10 of the firing pin either in or out of alignment with respect to front, rod-like element 9. To this effect the safety shaft 11 is provided with a single control lever 12 (FIG. 1) positioned on the side of the breech block 8 or, in the case of ambidexterous employment, is provided with two control levers 12 positioned on each side of the striker 8. In any event, the safety shaft 11 has a first cam surface defined by a flattened surface (FIG. 3) 13 that is provided in juxtaposition with a rocker lever 14. The rocker lever 14 is pivoted, by means of pin 15, to the crown 16 of the weapon, so as to extend between the sear 5 and the safety shaft 11.

Figure 4:
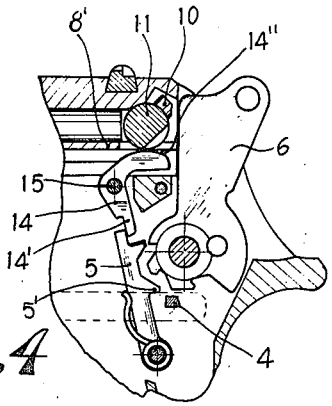

The rocker lever 14, as shown in FIG. 4, comprises a first arm 14' extending vertically toward the trip lever 5 and associated therewith; and a second arm 14'' extending horizontally toward the cam surface 13 of the safety shaft 11 and associated therewith. The second arm 14'' also slides in a slot 8' that is provided for this purpose on the inner surface of the breech block 8.

Figure 5:
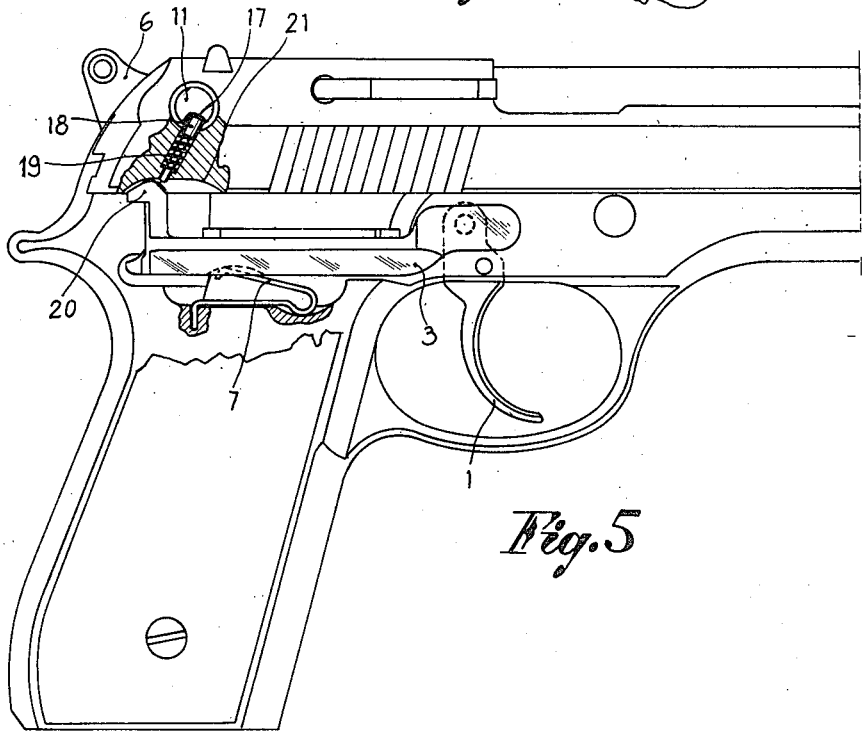
FIG. 5 is a partial sectional side view of the pistol taken from the side opposed to that shown in FIG. 1.

The safety shaft 11 has, further, a second cam surface 17 (FIG. 5) which is associated with a piston 18 that is guided in a groove which is provided for this purpose on a side of the breech block 8 and urged by a spring 19 that keeps the piston 18 always displaced toward the cam surface 17. The spring-loaded piston 18 is oriented toward and engages a terminal 20 formed on the trigger bar 3. The terminal 20 is, in turn, juxtaposed with respect to a seat 21 provided on the lower surface or rim, adjacent to the breech block 8, so as to carry out the functions of lowering the trigger bar 3 following the recoiling of the breech blocker 8 and of permitting the arrest of the hammer 6 by the sear 5.

Figure 2:
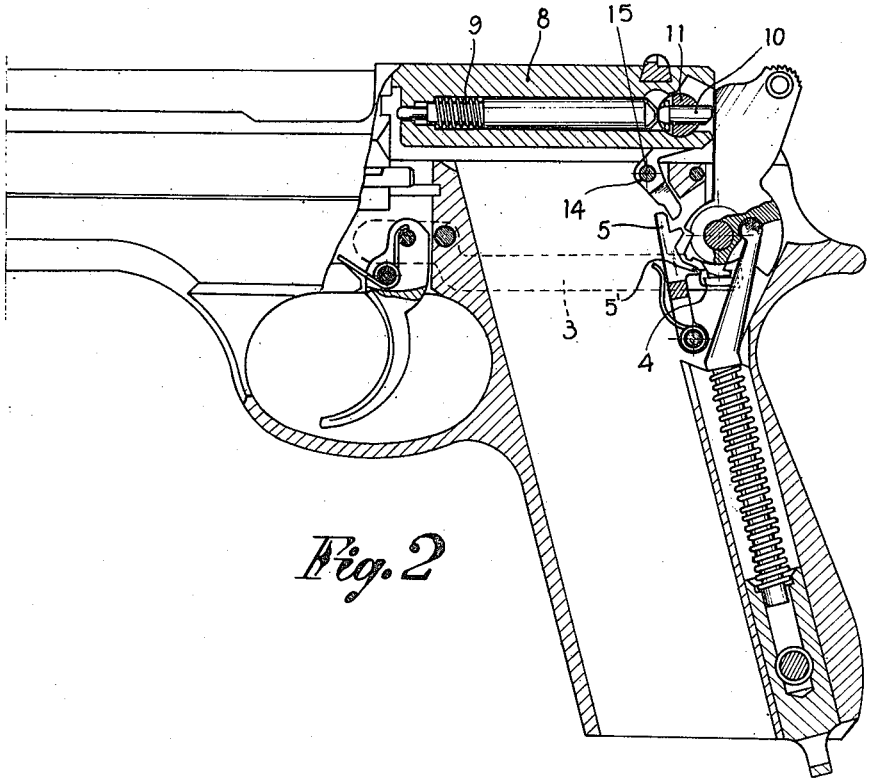
FIG. 2 is a longitudinal elevational view partially broken away and partially in section taken in the plane of the firing pin and the hammer.

The operation of the tripping mechanism of the pistol is, by itself, known and there is no need to reiterate it in great detail. It should suffice to mention that this operation is possible when the safety means is in the inactive position, so that the two rod-like elements 9 and 10 of the firing pin are in alignment, as is shown in FIG. 2. The terminal 20 of the trigger bar 3 sits in the seat 21 without being urged by the piston 18.

Figure 1:
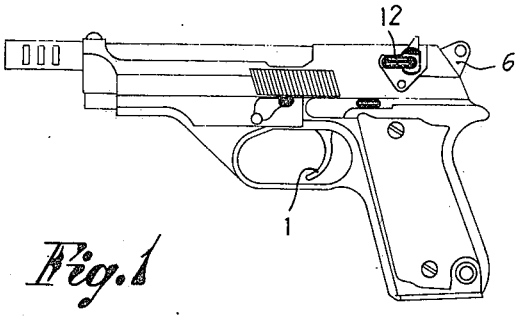
FIG. 1 is an external, side elevational view of the pistol comprising the present invention.

To have the safety operative, all that is necessary is to activate the control lever 12 and to rotate the safety shaft 11 to the position shown in FIG. 1. By such a rotation of the safety shaft 11 one obtains a corresponding displacement of the rear, rod-like element 10 of the firing pin, so as to interrupt the continuity of the latter and to bring the rear, rod-like element 10 into a position of non-alignment with respect to the hammer 6.

By rotating the safety shaft 11 one also obtains, in a phase immediately following the interruption of the firing pin, the action of the first cam surface 13 of the shaft 11 upon the upper arm 14'' of the rocker lever 14. In this manner, the rocker lever 14 is displaced so as to act, together with its lower arm 14', against the sear 5. This will cause the detachment of the sear 5 away from the hammer 6 and the automatic detachment thereof, even with a shell in the barrel, without any effect on the firing pin, since this has been previously interrupted.

Finally, the rotation of the safety shaft 11 determines, by means of the second cam surface 17, the downward push of the spring-loaded piston 18 which, acting on the terminal 20 of the trigger bar 3 (FIG. 5) downwardly displaces the trigger bar 3 so as to disengage the projection 4 from the projection 5' of the sear 5. Hence, the complete freedom of the tripping mechanism which is no longer subjected to forced actions, not even on the trigger, is achieved.

I claim:

1. Safety means for an automatic pistol of the type having a firing pin mounted on a breech block and formed of two elements, the rear one of which is movable into non-alignment with respect to the front one, and further having a sear for engaging the hammer of the pistol, and a trigger bar to arm the trigger of the pistol and associated with the sear thereof, said safety means comprising a safety shaft transversely mounted on the breech block and carrying the rear element of the firing pin; said shaft being displaceable and positionable angularly about its own axis so as to activate and deactivate the firing pin; an intermediate rocker lever engaged by a first cam surface provided on said shaft and associated with the sear to arrest the sear in the inactive position when the firing pin is deactivated; said rocker lever being positioned on the crown of the pistol and to extend between said shaft and the sear; and by a spring-loaded piston mounted in the breech block and engaged by a second cam surface on said shaft, to act on the trigger bar and displace it so as to engage it from the trip sear when the firing pin is deactivated.

2. The safety means according to claim 1, wherein said rocker lever is pivoted to the crown of the pistol and has a first arm extending vertically toward the sear and associated therewith; and a second arm extending horizontally toward the cam surface 13 and associated therewith; said second arm and said horizontal extension of said rocker lever being in juxtaposition with a throat provided in the breech block.

3. The safety means according to claim 1, wherein said first cam surface of said shaft is defined by a flat so as not to act on said rocker lever when the safety is in the inactive position.

4. The safety means according to claim 1, wherein said spring-loaded piston is positioned in a seat provided on the side of the breech block and extends toward the trigger bar,said piston always being displaced toward said shaft when the safety is in inactive position.

* * * * *